US011028629B2

(12) United States Patent
Hong et al.

(10) Patent No.: US 11,028,629 B2
(45) Date of Patent: Jun. 8, 2021

(54) DOOR GLASS ASSEMBLY CONFIGURED TO REDUCE IMPACT NOISE DURING UPWARD/DOWNWARD MOVEMENT OF A DOOR GLASS

(71) Applicants: HYUNDAI MOTOR COMPANY, Seoul (KR); KIA MOTORS CORPORATION, Seoul (KR)

(72) Inventors: Seok-Hyun Hong, Anyang-si (KR); Kwan-Hui Kang, Hwaseong-si (KR); Kuk-Hoon Lee, Hwaseong-si (KR); Soo-Bok Kim, Incheon (KR); Hee-Won Kang, Hwaseong-si (KR); Hoon-Ju Jo, Incheon (KR); Jun-Hee An, Seoul (KR); Ki-Su Kim, Incheon (KR); Nam-Hee Yun, Incheon (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 7 days.

(21) Appl. No.: 16/661,756

(22) Filed: Oct. 23, 2019

(65) Prior Publication Data

US 2020/0181965 A1 Jun. 11, 2020

(30) Foreign Application Priority Data

Dec. 5, 2018 (KR) ..... 10-2018-0155402

(51) Int. Cl.

| | |
|---|---|
| ***E05F 11/00*** | (2006.01) |
| ***E05F 5/00*** | (2017.01) |
| ***E05F 15/60*** | (2015.01) |

(52) U.S. Cl.

CPC ..... *E05F 5/003* (2013.01); *E05F 15/60* (2015.01); *E05Y 2900/55* (2013.01)

(58) Field of Classification Search

CPC ... E05F 11/38; E05F 11/382; E05F 2011/387; E05F 11/385; E05F 15/689;

(Continued)

(56) References Cited

U.S. PATENT DOCUMENTS 4,908,988 A * 3/1990 Yamamura ..... E05F 15/689 49/349
5,647,171 A * 7/1997 Wirsing ..... B60J 5/0416 49/375

(Continued)

FOREIGN PATENT DOCUMENTS

KR 20050027803 3/2005

*Primary Examiner* — Chi Q Nguyen
(74) *Attorney, Agent, or Firm* — Lempia Summerfield Katz LLC

(57) ABSTRACT

A door glass assembly is configured to reduce an impact noise generated when a door glass is moved upward/downward and may include a carrier plate coupled to a glass holder to which a door glass of a vehicle is secured. The carrier plate is installed inside a door of the vehicle so as to be movable upward/downward. A module plate, on which the carrier plate is installed so as to be movable upward/downward, is installed inside the door of the vehicle. A driving motor is provided to move the carrier plate upward/downward. The module plate and the carrier plate are provided with an impact noise preventing means for gradually decelerating and stopping the carrier plate when the door glass is being maximally moved upward or downward.

13 Claims, 11 Drawing Sheets

(58) Field of Classification Search
CPC ..... E05F 11/405; E05Y 2900/55; E05Y 2800/422; B60J 1/17; B60J 5/04
USPC ..... 49/324, 334, 349, 381, 502, 501
See application file for complete search history.

(56) References Cited

U.S. PATENT DOCUMENTS

| | | | | |
|---|---|---|---|---|
| 7,017,303 | B2 | 3/2006 | Cho | |
| 10,287,811 | B1 * | 5/2019 | Arimoto | E05F 11/485 |
| 2004/0111970 | A1 * | 6/2004 | Fenelon | E05F 11/525<br>49/349 |
| 2005/0055882 | A1 | 3/2005 | Cho | |
| 2009/0282744 | A1 * | 11/2009 | Jung | E05F 11/486<br>49/502 |
| 2010/0031576 | A1 * | 2/2010 | Sasaki | E05F 11/485<br>49/360 |
| 2013/0111816 | A1 * | 5/2013 | Kinoshita | E05F 11/486<br>49/376 |
| 2013/0318876 | A1 * | 12/2013 | Takakura | E05F 15/689<br>49/349 |
| 2013/0340347 | A1 * | 12/2013 | Twork | E05F 11/385<br>49/358 |
| 2014/0007507 | A1 * | 1/2014 | Umemura | E05F 11/486<br>49/349 |
| 2017/0167177 | A1 * | 6/2017 | Shimizu | E05F 11/483 |
| 2019/0226264 | A1 * | 7/2019 | Shiroma | E05F 11/486 |
| 2019/0257134 | A1 * | 8/2019 | Kashiwabara | E05F 11/486 |

* cited by examiner

DOOR GLASS ASSEMBLY CONFIGURED TO REDUCE IMPACT NOISE DURING UPWARD/DOWNWARD MOVEMENT OF A DOOR GLASS

CROSS-REFERENCE TO RELATED APPLICATIONS

This application claims priority to Korean Patent Application No. 10-2018-0155402, filed on Dec. 5, 2018, which is incorporated herein by reference in its entirety.

BACKGROUND OF THE DISCLOSURE

Field of the Disclosure

The present disclosure relates to a door glass installed on a door of a vehicle, and more particularly, to a door glass assembly, which reduces an impact noise when a door glass is moved upward/downward and which is configured to reduce an impact noise generated when the door glass is stopped during a maximum upward or downward movement of the door glass.

Description of Related Art

A door glass is installed on a door of a vehicle for lighting and ventilation. The door glass is provided to be moved upward/downward by a regulator or the like.

As illustrated in FIG. 1, a carrier plate 140 is installed and can be moved upward/downward in a door. A glass holder 11, to which a lower end of a door glass 10 is fastened, is fastened to the carrier plate 140. In addition, a module plate 120, in which the carrier plate 140 is installed and can be moved upward/downward, is installed inside the door. A regulator (not shown) for moving the carrier plate 140 upward/downward and a driving motor 130 for driving the regulator are installed in the module plate 120.

When the door glass 10 is maximally moved upward or downward, the glass holder 11 supporting the door glass 10 is brought into contact with an internal structure of the door, or the carrier plate 140 is brought into contact with the module plate 120, thereby generating an impact noise.

In order to prevent the impact noise from being generated, in high-level or luxury vehicles, as illustrated in FIG. 1, a variable speed type motor is employed as the driving motor 130. A speed of the driving motor 130 is reduced when the door glass is maximally moved upward or downward to reduce the impact noise generated when the glass holder 11 is brought into contact with the structure of the door.

Compared to a typical motor, however, the above-described variable speed type motor is expensive. As a result, this becomes a factor by which a manufacturing cost of the vehicle is increased. As described above, since the manufacturing cost is increased, the variable speed type motor has been applied only to high-level or luxury vehicles. It has been difficult to apply the variable speed type motor to other types of vehicles.

In addition, there are problems in that a position of the door glass 10 must be precisely checked or additional components must be installed in order to adjust a speed of the driving motor 130.

The contents described in the Description of Related Art section are to help in understanding the background of the present disclosure. The Description of the Related Art section may include what is not previously known to those having ordinary skill in the art to which the present disclosure pertains.

SUMMARY OF THE DISCLOSURE

The present disclosure has been made to solve the above-mentioned problem. An object of the present disclosure is to provide a door glass assembly configured to reduce an impact noise when a door glass is moved upward/downward. The door glass assembly is provided with an impact noise preventing means, which buffers an upward/downward movement of a door glass when the door glass is maximally moved upward or downward, to prevent an impact noise from being generated when the door glass is maximally moved upward or downward.

Another object of the present disclosure is to provide a door glass assembly reducing an impact noise when a door glass is moved upward/downward. The door glass assembly is configured using a typical or conventional motor such that the impact noise is not generated when the door glass is maximally moved upward or downward, instead of having to employ a high-priced variable speed type motor, thereby enabling a manufacturing cost to be reduced.

In order to achieve the above objects, a door glass assembly according to the present disclosure is configured to reduce an impact noise generated when a door glass is moved upward/downward and may include a carrier plate coupled to a glass holder to which a door glass of a vehicle is secured. The carrier plate is installed inside a door of the vehicle so as to be movable upward/downward. The door glass assembly has a module plate on which the carrier plate is installed so as to be movable upward/downward. The module plate is installed inside the door of the vehicle. A driving motor is provided to move the carrier plate upward/downward. The module plate and the carrier plate are provided with an impact noise preventing means for gradually decelerating and stopping the carrier plate when the door glass is being maximally moved upward or downward.

The impact noise preventing means may include a stopper installed on any one of the module plate or the carrier plate and an elastic member installed on the other of the module plate or the carrier plate to be brought into contact with the stopper when the door glass is maximally moved upward or downward.

The impact noise preventing means may include stoppers installed on an upper portion and a lower portion of the module plate, respectively, to limit upward and downward movements of the module plate. The impact noise preventing means may also include an elastic member installed on one side of the carrier plate to be brought into contact with the stopper and compressed immediately before the carrier plate is stopped when the door glass is maximally moved upward or downward.

The stoppers may include an upper limit stopper formed on the upper portion of the module plate to limit an upward movement of the door glass and a lower limit stopper formed on the lower portion of the module plate to limit a downward movement of the door glass.

The upper limit stopper and the lower limit stopper may be formed to protrude from the module plate in a widthwise direction of a vehicle.

The upper limit stopper and the lower limit stopper may be formed on a trajectory of the carrier plate.

The elastic member may be a spring, which is installed on the carrier plate to be compressed or lengthened in an upward/downward movement direction of the carrier plate.

The spring may be a coil spring, which is compressed or lengthened in an upward/downward movement direction of the carrier plate.

The carrier plate may include a guide formed thereon to restrict a side surface of the elastic member and accommodate the elastic member therein.

The guide may be formed to have opened upper and lower ends so as to allow the stopper to enter therein and to compress the elastic member.

The elastic member may be provided with caps provided at an upper end and a lower end thereof to cover the upper end and the lower end of the elastic member, respectively.

The impact noise preventing means may include elastic members installed on an upper portion and a lower portion of the module plate, respectively, to limit upward and downward movements of the module plate. The impact noise preventing means may also include a stopper installed on one side of the carrier plate to be brought into contact with the elastic member and to compress the elastic member immediately before the carrier plate is stopped when the door glass is maximally moved upward or downward.

The stopper may be formed to protrude from the carrier plate in a widthwise direction of a vehicle.

The elastic members installed on the upper portion and the lower portion of the module plate, respectively, may be formed on a trajectory of the carrier plate.

The elastic member may be a spring, which is installed on the module plate to be compressed or lengthened in an upward/downward movement direction of the carrier plate.

The module plate may include a guide formed thereon to restrict a side surface of the elastic member and accommodate the elastic member therein.

BRIEF DESCRIPTION OF THE DRAWINGS

FIG. 4A is an enlarged view illustrating a state immediately before a door glass is maximally moved upward, and FIG. 4B is an enlarged view illustrating a state in which the door glass has been maximally moved upward.

FIG. 6A is an enlarged view illustrating a state immediately before the door glass is maximally moved downward, and FIG. 6B is an enlarged view illustrating a state in which the door glass has been maximally moved downward.

DESCRIPTION OF SPECIFIC EMBODIMENTS

Figure 1:
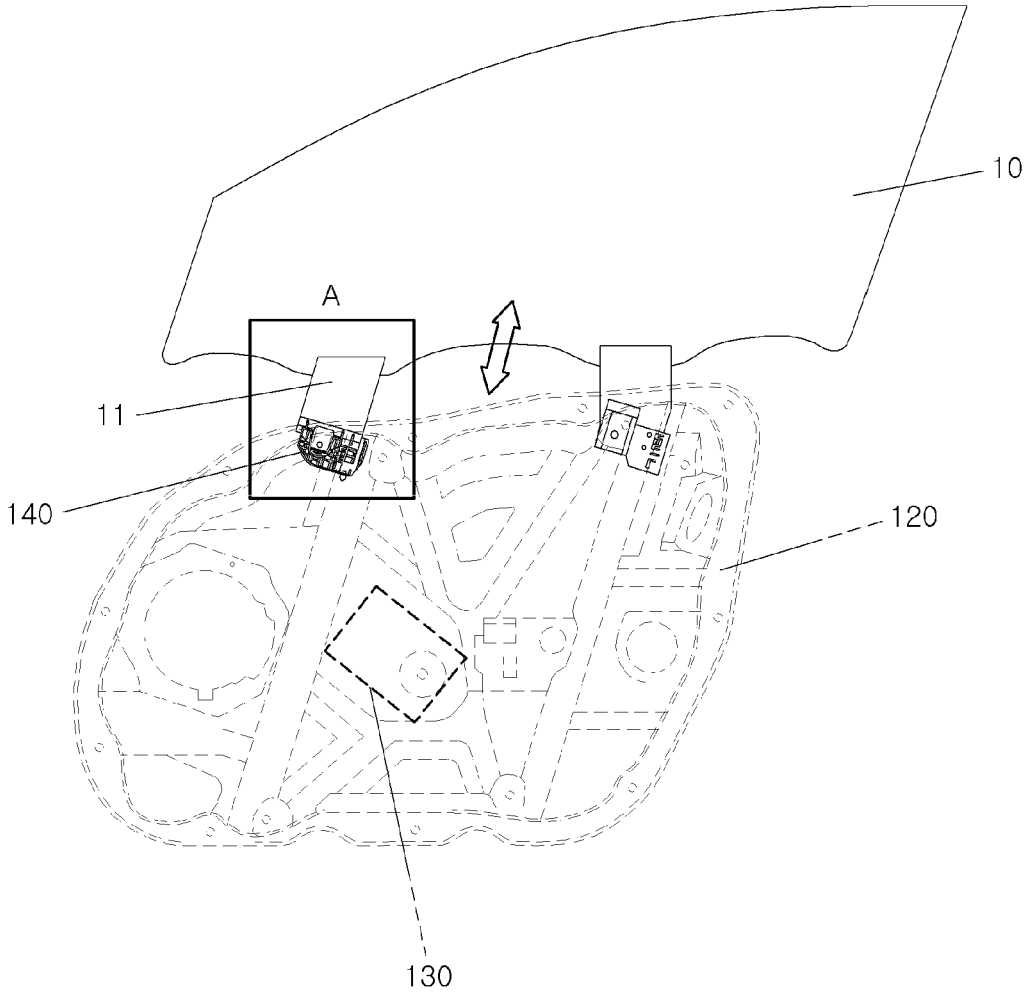
FIG.1(Prior Art)
FIG. 1 is a side view illustrating a state in which a door glass is installed on a module plate of a door according to the prior art.
Figure 2:
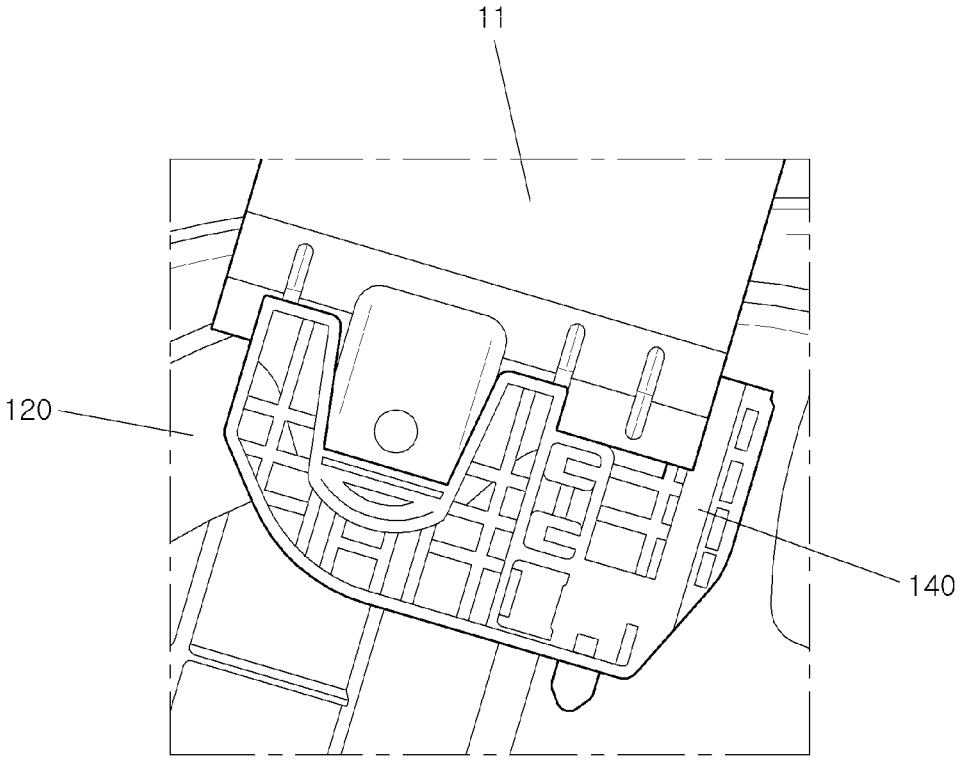
FIG.2(Prior Art)
FIG. 2 is an enlarged view of the "A" portion in FIG. 1.

Hereinafter, embodiments of the present disclosure are described in detail with reference to the accompanying drawings. However, in the following description and the accompanying drawings, a detailed description has been omitted of well-known functions or configurations that can obscure the subject of the present disclosure. In addition, it should be noted that the same components are denoted by the same reference numerals as much as possible throughout the drawings.

Hereinafter, a door glass assembly according to the present disclosure, which reduces an impact noise during an upward/downward movement of a door glass is described with reference to the accompanying drawings.

Figure 3:
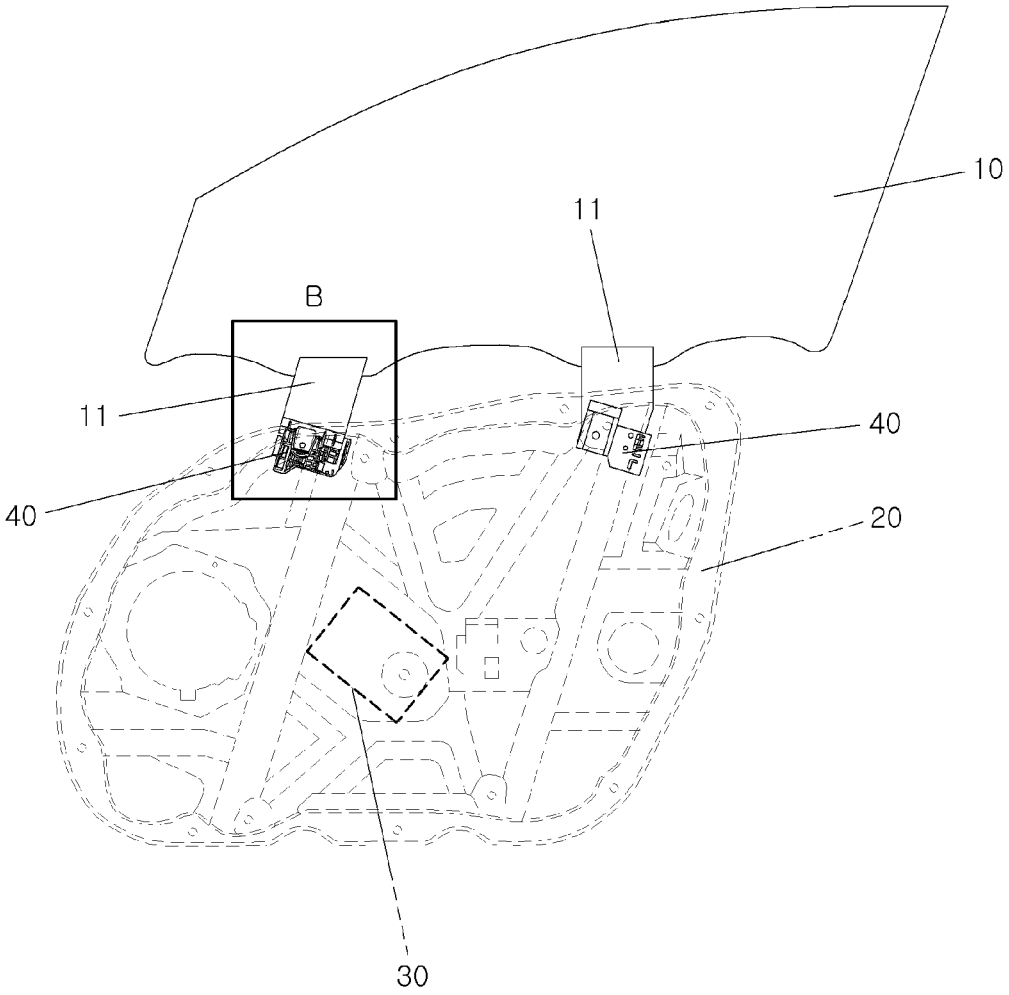
FIG. 3 is a side view illustrating a state in which a door glass of a door glass assembly according to the present disclosure has been maximally moved upward, where the door glass assembly reduces an impact noise during an upward/downward movement of a door glass.
Figure 5:
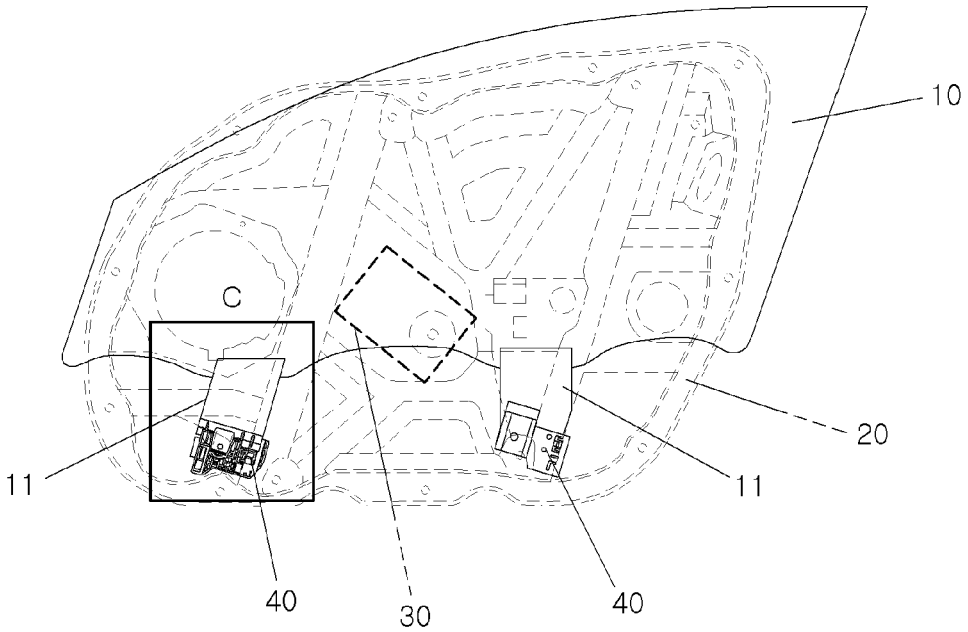
FIG. 5 is a side view illustrating a state in which the door glass of the door glass assembly according to the present disclosure has been maximally moved downward, where the door glass assembly reduces an impact noise during an upward/downward movement of the door glass.

A door glass assembly according to the present disclosure is depicted in FIGS. 3 and 5 and may reduce an impact noise during an upward/downward movement of a door glass. The door glass assembly includes a carrier plate 40 coupled to a glass holder 11 to which a door glass 10 of a vehicle is secured. The carrier plate 40 is installed inside a door of the vehicle so as to be movable upward/downward The door glass assembly includes a module plate 20 on which the carrier plate 40 is installed so as to be movable upward/downward. The module plate is installed inside the door of the vehicle. A driving motor 30 is provided to move the carrier plate 40 upward/downward. The module plate 20 and the carrier plate 40 are provided with an impact noise preventing means for gradually decelerating and stopping the carrier plate 40 when the door glass 10 is being maximally moved upward or downward.

The module plate 20, which is provided with various devices installed in the door, is provided inside the door of the vehicle.

One side of the door glass 10, for example, a lower end of the door glass 10 is fixed to the glass holder 11.

The carrier plate 40 is installed on the module plate 20 so as to be able to move upward/downward. The glass holder 11 is installed on an upper end of the carrier plate 40. The module plate 20 is provided with a regulator (not shown in the drawings) for moving the carrier plate 40 upward/downward and the driving motor 30 is provided on the module plate to allow the regulator to be operated.

Unlike the prior art, in the present disclosure, a typical motor, i.e., a motor having no variable speed function, is employed as the driving motor 30. In the prior art, a high-priced variable speed type motor has to be indispensably employed in order to eliminate the impact noise generated when the door glass 10 is maximally moved upward or downward. However, in the present disclosure, the door glass assembly employs the impact noise preventing means, which is described further below. Even though a typical motor having no variable speed function is employed, it is possible to obtain the same effect as that of the prior art. The effect is that the impact noise is not generated at the time when the maximum upward or downward movement of the door glass 10 is completed.

The impact noise preventing means is provided on the module plate 20 and the carrier plate 40 to be operated immediately before a completion of the maximum upward movement (see FIGS. 3, 4A, and 4B) or the maximum downward movement (see FIGS. 5, 6A, and 6B) of the door glass 10. When the upward or downward movement of the carrier plate 40 is completed, the carrier plate 40 is decelerated by the impact noise preventing means and the upward or downward movement of the carrier plate is finally completed. Therefore, when the door glass 10 is maximally moved upward or downward, even though the carrier plate 40 is brought into contact with module plate 20, no impact noise is generated.

The impact noise preventing means is described in detail below.

In one embodiment of the present disclosure, the impact noise preventing means may include stoppers 21 and 22 formed on the module plate 20 and may include an elastic member 51 installed on the carrier plate 40.

The stoppers 21 and 22 are formed on an upper portion and a lower portion of the module plate 20, respectively. The stoppers are formed on a trajectory of the carrier plate 40. An upper limit stopper 21 (see FIGS. 4A, 4B, and 7) is formed at a position to which the carrier plate 40 is maximally moved upward, and a lower limit stopper 22 (see FIGS. 6A, 6B, and 7) is formed at a position to which the carrier plate 40 is maximally moved downward.

The elastic member 51 is a member that is compressed when an external force is applied thereto and is restored when the external force is removed. This elastic member is installed on the carrier plate 40.

The elastic member is installed on the carrier plate 40 so that when the carrier plate 40 is maximally moved upward (see FIG. 4B), the elastic member 51 is compressed by the upper limit stopper 21 to decelerate an upward movement speed of the carrier plate 40 and gradually stop the carrier plate 40. In addition, when the carrier plate 40 is maximally moved downward (see FIG. 6B), the elastic member 51 is compressed by the lower limit stopper 22 to decelerate a downward movement speed of the carrier plate 40 and gradually stop the carrier plate 40. When the carrier plate 40 is maximally moved upward or downward, the elastic member 51 decelerates the speed of the carrier plate 40 to prevent the impact noise from being generated when the carrier plate 40 is stopped.

The elastic member 51 in one example is a spring, which is compressed when it is brought into contact with the upper limit stopper 21 or the lower limit stopper 22 and which is restored to an original state when the contact between the elastic member and the stopper is released. For example, a coil spring 51 may be employed that is compressed or restored in an upward/downward movement direction of the carrier plate 40, as the elastic member 51.

Figure 8:
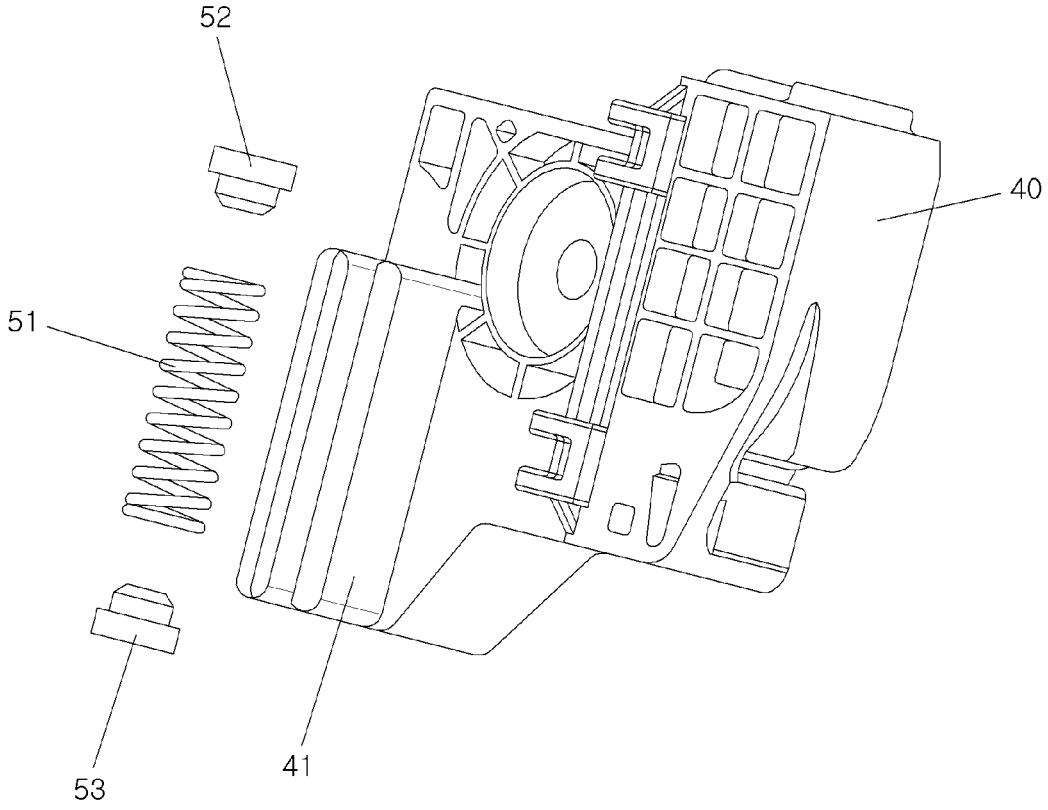
FIG. 8 is a perspective view illustrating a state in which a spring is installed on a carrier plate of the door glass assembly according to the present disclosure, which reduces an impact noise during an upward/downward movement of the door glass.
Figure 9:
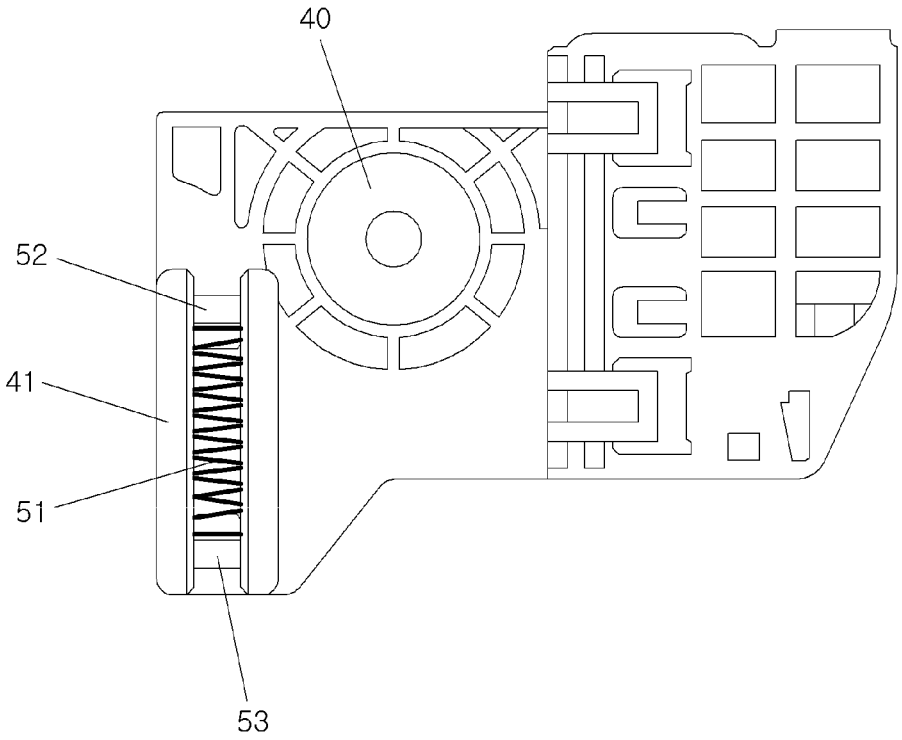
FIG. 9 is a plan view illustrating a state in which the spring is installed on the carrier plate of the door glass assembly according to the present disclosure, which reduces an impact noise during an upward/downward movement of the door glass.

In order to install the elastic member 51 on the carrier plate 40, a guide 41 (see FIGS. 8 and 9) is formed on the carrier plate in the upward/downward movement direction of the carrier plate 40. The elastic member in the form of the coil spring 51 is accommodated inside the guide 41.

The guide 41 restricts both side surfaces of the elastic member 51 to allow the elastic member 51 to be installed on the carrier plate 40.

In addition, an upper portion and a lower portion of the guide 41 are formed to have an opened shape. The upper limit stopper 21 and the lower limit stopper 22 enter the inside of the guide 41 to be in contact with the elastic member 51.

Furthermore, an upper cap 52 and a lower cap 53 (see FIGS. 8 and 9) are provided at an upper end and a lower end of the elastic member 51, respectively, in the guide 41 to allow the upper limit stopper 21 and the lower limit stopper 22 to compresses the elastic member 51 through the upper cap 52 and the lower cap 53.

Meanwhile, a stopper formed on the carrier plate 40 and elastic members provided on the upper and lower portions of the module plate 20, respectively, may be employed as another embodiment of the impact noise preventing means.

In this embodiment, the positions of the stoppers 21 and 22 and the elastic member 51 in the previous embodiment are interchanged with each other to form the stoppers on the carrier plate 40 and install the elastic member on the module plate 20.

The stoppers are formed on the carrier plate 40 to protrude from the carrier plate 40.

Further, the elastic members, which are compressed by the carrier plate 40, are installed on the upper and lower portions of the module plate 20, respectively. Also, in this embodiment, the guide is formed on the module plate 20 and the elastic member is provided inside the guide. The elastic members are installed on the upper and lower portions of the module plate 20, respectively.

When the carrier plate 40 is maximally moved upward to fully close the door glass 10, the stopper is stopped while compressing the elastic member provided on the upper portion of the module plate 20 to prevent the impact noise from being generated. In addition, when the carrier plate 40 is maximally moved downward to fully open the door glass 10, the stopper is stopped while compressing the elastic member provided on the lower portion of the module plate 20 to prevent the impact noise from being generated.

An operation of the door glass assembly according to the present disclosure configured to reduce the impact noise during the upward/downward movement of the door glass and having the above described configuration is described as follows.

When an occupant manipulates a switch installed inside the vehicle, the driving motor 30 is rotated.

When the driving motor 30 is rotated, the carrier plate 40 is moved upward or downward on the module plate 20 in accordance with a rotational direction of the driving motor 30.

If the occupant operates to move the door glass 10 maximally upward or downward, the carrier plate 40 is moved upward or downward on the module plate 20 to a position at which the carrier plate 40 may be maximally moved upward or downward. When the operation is completed, (i.e., when the maximum upward or downward movement of the door glass 10 is completed), the carrier plate 40 is gradually decelerated by the impact noise preventing means immediately before the end of the operation and is then stopped to prevent the impact noise from be generated.

For example, if the occupant maximally moves the door glass 10 upward to allow the door glass to be in a state shown in FIG. 3, when an upward movement of the carrier plate 40 is completed, the carrier plate 40 is buffered by the impact noise preventing means and is then stopped to eliminate the impact noise, which is otherwise generated when the door glass 10 is maximally moved upward.

Figure 4A:
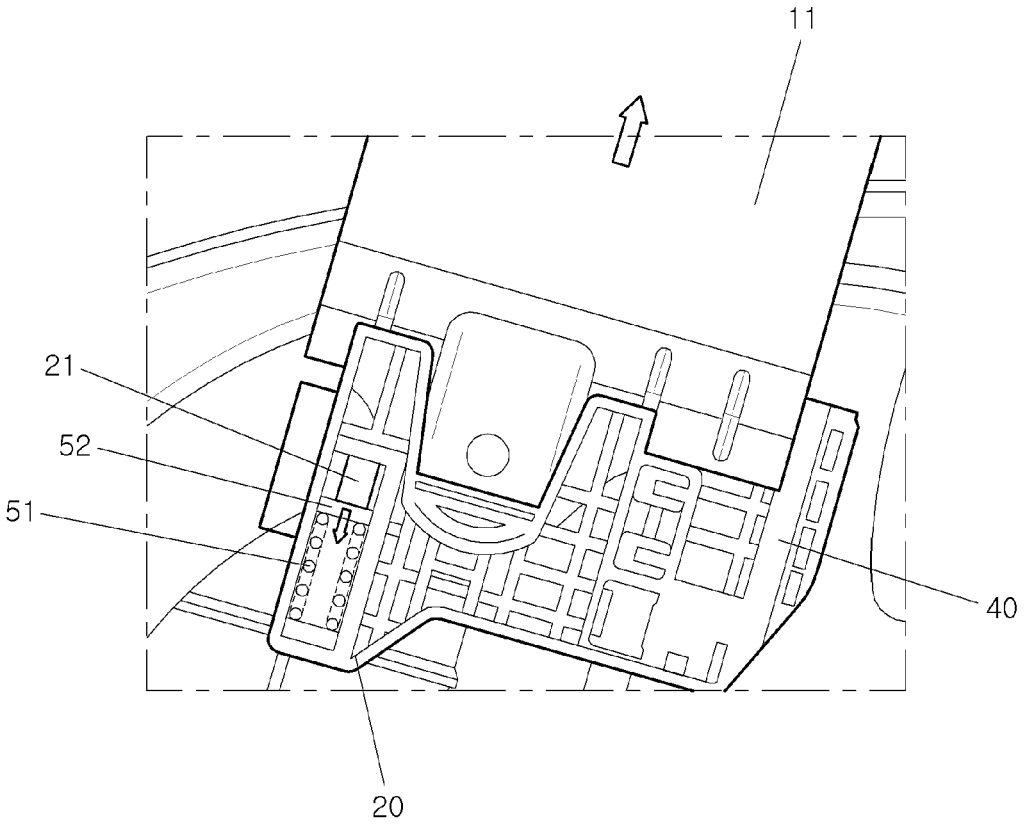
FIGS. 4A and 4B are enlarged views of the "B" portion in FIG. 3, where
Figure 4B:
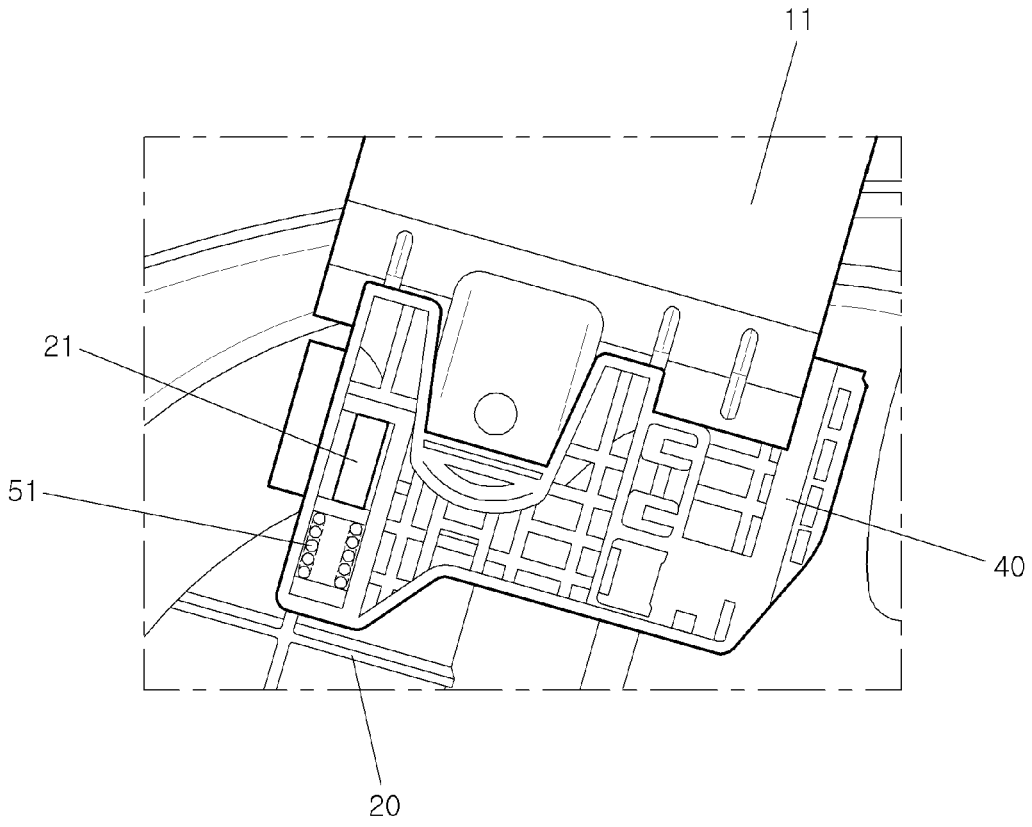

When the door glass 10 is maximally moved upward, the spring 51 is brought into contact with the upper limit stopper 21 just before completion of the upward movement (see FIG. 4A). In a state in which the spring 51 is in contact with the upper limit stopper 21, a driving force of the driving motor 30 is canceled out by an elastic force of the spring 51, and an upward movement of the carrier plate 40 is consequently decelerated.

When a maximum upward movement of the door glass 10 is completed (see FIG. 4B), the spring 51 is in a fully compressed state and the carrier plate 40 cannot be moved upward any more.

Figure 6A:
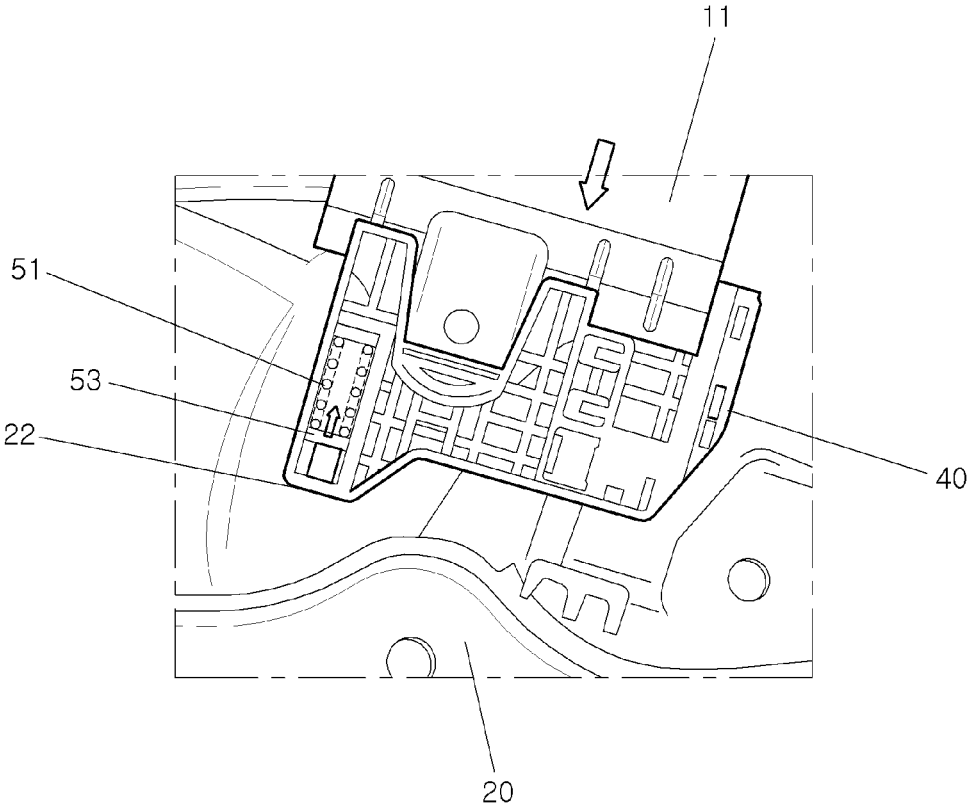
FIGS. 6A and 6B are enlarged views of the "C" portion in FIG. 5, where
Figure 6B:
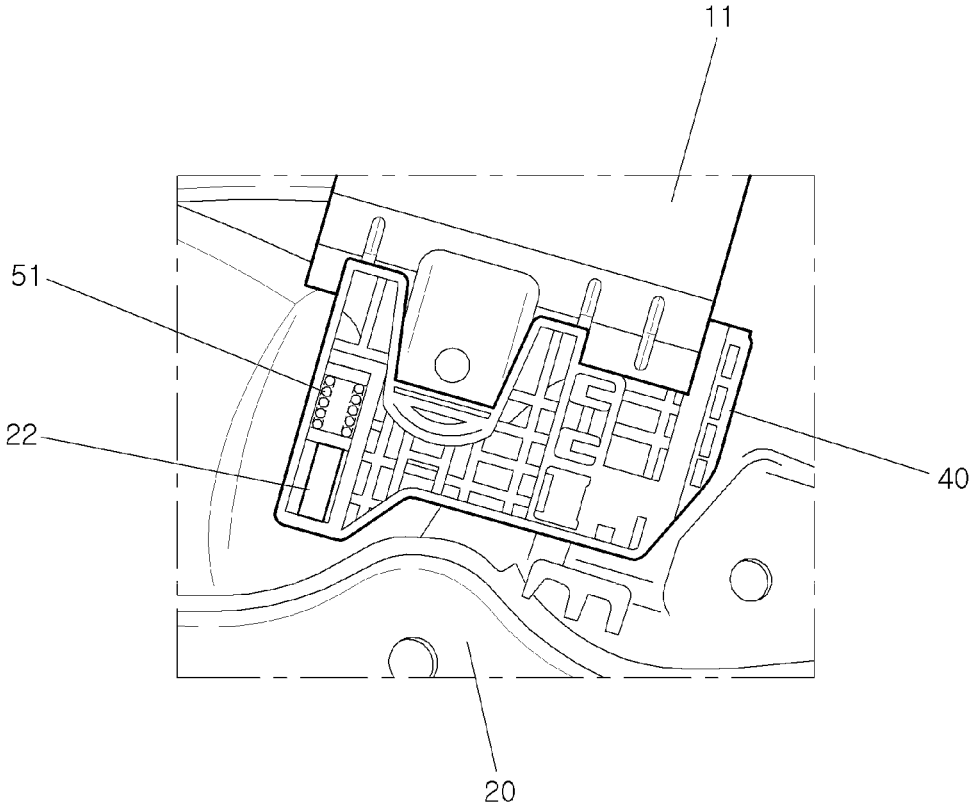
Figure 7:
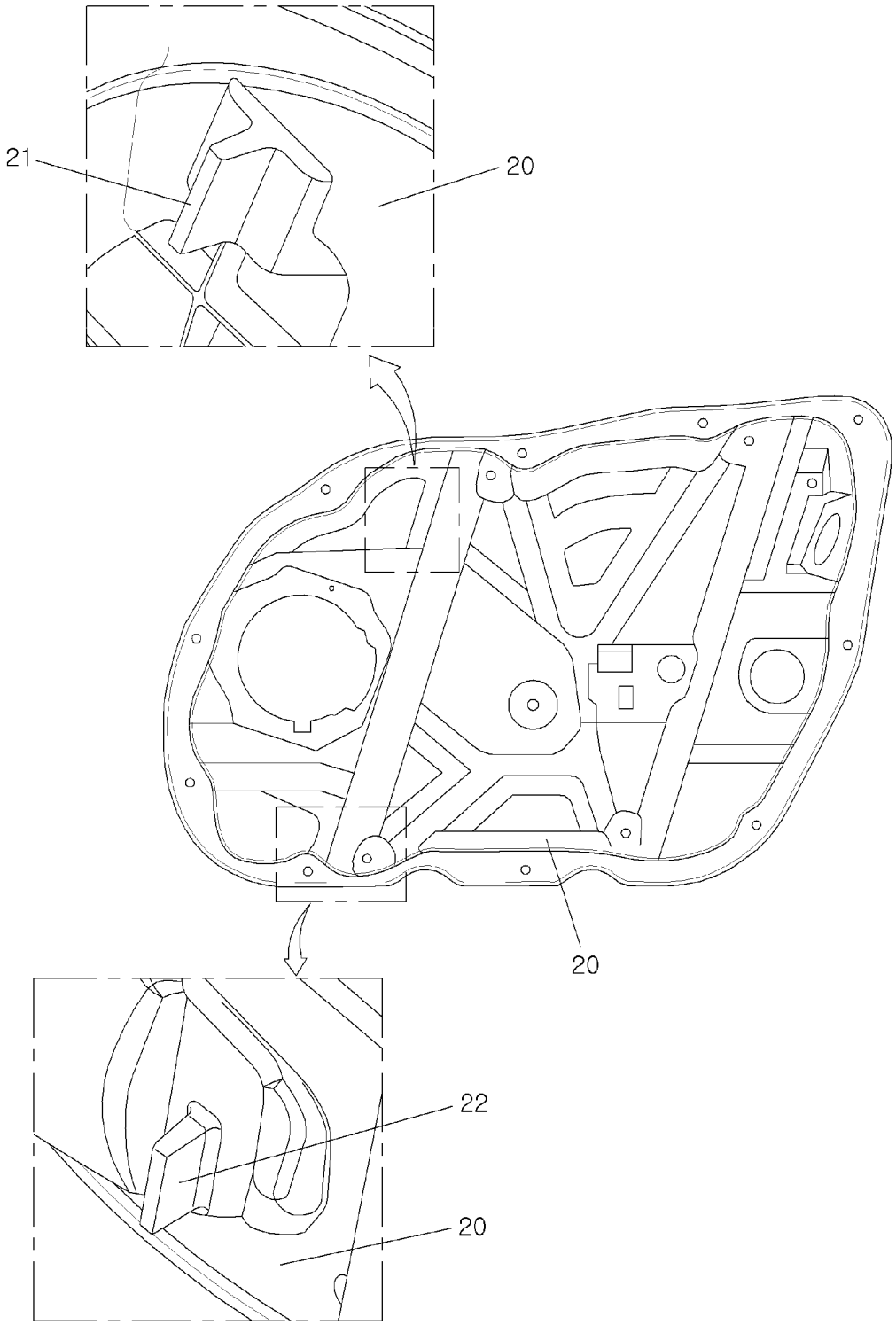
FIG. 7 is a view illustrating a state in which stoppers are formed on an upper portion and a lower portion, respectively, of a module plate in a door to which the door glass assembly according to the present disclosure is applied, where the door glass assembly reduces an impact noise during an upward/downward movement of the door glass.

FIGS. 5, 6A, and 6B illustrate a state in which the door glass 10 is being maximally moved downward.

As illustrated in FIG. 5, even when the door glass 10 is maximally moved downward, the spring 51 is brought into contact with the lower limit stopper 22 just before the maximum downward movement of the door glass 10 is completed (see FIG. 6A). When the spring 51 is in contact with the lower limit stopper 22, the downward movement of the carrier plate 40 is decelerated. When the spring 51 is fully compressed, the carrier plate 40 cannot be moved downward any more. Accordingly, a state in which the door glass 10 is maximally moved downward is maintained.

As described above, the spring 51 decelerates and then stops the carrier plate 40 at a point in time when the maximum upward movement of the door glass 10 is completed or when the maximum downward movement of the door glass 10 is completed. Therefore, no impact noise is generated even though the carrier plate 40 is brought into contact with the module plate 20 when the door glass 10 is maximally moved upward or downward.

Further, without using a high-priced variable speed type motor for preventing the impact noise from being generated, it is possible to prevent the impact noise from being generated even if a typical motor is employed as the driving motor 30.

Like the previously described example, in the embodiment in which the stoppers are formed on the carrier plate 40 and the elastic member is installed on the module plate 20, the stoppers are brought into contact with the elastic member of the module plate 20 during movement of the door glass 10 at the time when the maximum upward movement and the maximum downward movement of the door glass 10 are completed. Thus, the carrier plate is decelerated and is then stopped, thereby making it possible to prevent the impact noise from being generated.

According to the door glass assembly of the present disclosure having the above-described configuration for reducing the impact noise during the upward/downward movement of the door glass, when the door glass is maximally moved upward or downward, the impact noise preventing means is brought into contact with the glass holder to gradually decelerate the glass holder. Thus, it is possible to reduce the noise generated when the door glass is maximally moved upward or downward.

In addition, since a low-priced typical motor can be applied, instead of using a high-priced variable speed type motor, in order to prevent the noise generated when the door glass is maximally moved upward or downward, it is possible to reduce a manufacturing cost of the vehicle.

Although the present disclosure has been described with a focus on novel features of the present disclosure applied to various embodiments, it will be apparent to those having ordinary skill in the art that various deletions, substitutions, and changes in the form and details of the apparatus and method described above may be made without departing from the scope of the present disclosure. Accordingly, the scope of the present disclosure is defined by the appended claims rather than by the foregoing description. All modifications within the equivalent scope of the appended claims are embraced within the scope of the present disclosure.

What is claimed is:

1. A door glass assembly configured to reduce an impact noise generated when a door glass is moved upward/downward, the door glass assembly comprising:
- a carrier plate coupled to a glass holder, the door glass of a vehicle being secured to the glass holder, and the carrier plate and the glass holder being installed inside a door of the vehicle so as to be movable upward/downward;
- a module plate, the carrier plate being installed on the module plate so as to be movable upward/downward, and the module plate being installed inside the door of the vehicle; and
- a driving motor provided to move the carrier plate upward/downward,
- wherein the module plate and the carrier plate are provided with an impact noise preventing means for gradually decelerating and stopping the carrier plate when the door glass is being maximally moved upward or downward,
- wherein the impact noise preventing means comprises
  - stoppers installed on an upper portion and a lower portion of the module plate, respectively, to limit upward and downward movements of the module plate, and
  - an elastic member installed on one side of the carrier plate to be brought into contact with the stoppers and compressed immediately before the carrier plate is stopped when the door glass is maximally moved upward or downward, and
- wherein the elastic member is provided with caps provided at an upper end and a lower end thereof to cover the upper end and the lower end of the elastic member, respectively.

2. The door glass assembly of claim 1, wherein the stoppers comprise:
- an upper limit stopper formed on the upper portion of the module plate to limit an upward movement of the door glass; and
- a lower limit stopper formed on the lower portion of the module plate to limit a downward movement of the door glass.

3. The door glass assembly of claim 2, wherein the upper limit stopper and the lower limit stopper are formed to protrude from the module plate in a widthwise direction of the vehicle.

4. The door glass assembly of claim 2, wherein the upper limit stopper and the lower limit stopper are formed on a trajectory of the carrier plate.

5. The door glass assembly of claim 1, wherein the elastic member is a spring installed on the carrier plate to be compressed or lengthened in an upward/downward movement direction of the carrier plate.

6. The door glass assembly of claim 5, wherein the spring is a coil spring, to be compressed or lengthened in the upward/downward movement direction of the carrier plate.

7. The door glass assembly of claim 5, wherein the carrier plate comprises a guide formed thereon to restrict a side surface of the elastic member and accommodate the elastic member therein.

8. The door glass assembly of claim 7, wherein the guide is formed to have opened upper and lower ends so as to allow the stopper to enter therein and to compress the elastic member.

9. A door glass assembly configured to reduce an impact noise generated when a door glass is moved upward/downward, the door glass assembly comprising:

a carrier plate coupled to a glass holder, the door glass of a vehicle being secured to the glass holder, and the carrier plate and the glass holder being installed inside a door of the vehicle so as to be movable upward/downward;

a module plate, the carrier plate being installed on the module plate so as to be movable upward/downward, and the module plate being installed inside the door of the vehicle; and a driving motor provided to move the carrier plate upward/downward, wherein the module plate and the carrier plate are provided with an impact noise preventing means for gradually decelerating and stopping the carrier plate when the door glass is being maximally moved upward or downward, wherein the impact noise preventing means comprises elastic members installed on an upper portion and a lower portion of the module plate, respectively, to limit upward and downward movements of the module plate, and a stopper installed on one side of the carrier plate to be brought into contact with the elastic members and to compress the elastic members immediately before the carrier plate is stopped when the door glass is maximally moved upward or downward, and wherein the elastic members are each provided with a cap at an upper end or a lower end thereof to cover the upper end or the lower end of the elastic members, respectively, that is brought into contact with the stopper.

10. The door glass assembly of claim 9, wherein the stopper is formed to protrude from the carrier plate in a widthwise direction of a vehicle.

11. The door glass assembly of claim 9, wherein the elastic members installed on the upper portion and the lower portion of the module plate, respectively, are formed on a trajectory of the carrier plate.

12. The door glass assembly of claim 9, wherein each elastic member is a spring installed on the module plate to be compressed or lengthened in an upward/downward movement direction of the carrier plate.

13. The door glass assembly of claim 12, wherein the module plate comprises a guide formed thereon to restrict a side surface of each spring and to accommodate each spring therein.

* * * * *